US007717415B2

(12) United States Patent
Kim et al.

(10) Patent No.: US 7,717,415 B2
(45) Date of Patent: May 18, 2010

(54) PAPER FEEDING DEVICE

(75) Inventors: Won-taek Kim, Gyeonggi-do (KR); Myung-woo Yang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 686 days.

(21) Appl. No.: 10/893,918

(22) Filed: Jul. 20, 2004

(65) Prior Publication Data

US 2005/0035534 A1 Feb. 17, 2005

(30) Foreign Application Priority Data

Jul. 23, 2003 (KR) ..... 10-2003-0050490

(51) Int. Cl.
*B65H 7/08* (2006.01)

(52) U.S. Cl. ..... 271/110; 271/117

(58) Field of Classification Search ..... 271/110, 271/117, 118, 121, 152, 153, 25, 31, 130
See application file for complete search history.

(56) References Cited

U.S. PATENT DOCUMENTS 4,223,886 A * 9/1980 Vogt ..... 271/246
4,346,878 A * 8/1982 Aizawa ..... 271/118
4,925,062 A * 5/1990 Tsukamoto et al. ..... 271/115
5,064,182 A * 11/1991 Tokutsu ..... 271/3.17
5,209,465 A * 5/1993 Sayama et al. ..... 271/110
5,228,673 A * 7/1993 Osonoe ..... 271/10.01
5,344,134 A * 9/1994 Saeki et al. ..... 271/122
5,347,350 A * 9/1994 Nakahata et al. ..... 399/23
5,351,945 A * 10/1994 Asakawa et al. ..... 271/118
5,356,129 A * 10/1994 Godlewski ..... 271/212
5,397,118 A * 3/1995 Iida et al. ..... 271/155
5,497,986 A * 3/1996 Kudo ..... 271/122
5,552,859 A * 9/1996 Nakagawa et al. ..... 399/23
5,653,434 A * 8/1997 Petocchi et al. ..... 271/122
5,678,814 A * 10/1997 Yokoyama et al. ..... 271/9.05
5,775,823 A * 7/1998 Bekki et al. ..... 400/629
5,842,694 A * 12/1998 Brooks et al. ..... 271/38
5,893,555 A * 4/1999 Kawada et al. ..... 271/117
5,984,298 A * 11/1999 Wada et al. ..... 271/121

(Continued)

FOREIGN PATENT DOCUMENTS

JP 02204225 A * 8/1990

(Continued)

OTHER PUBLICATIONS

Japanese Office Action dated Sep. 8, 2009, issued in corresponding Japanese Patent Application No. 2004-215576.

*Primary Examiner*—Patrick Mackey
*Assistant Examiner*—Michael C McCullough
(74) *Attorney, Agent, or Firm*—Staas & Halsey LLP

(57) ABSTRACT

A paper feeding device which includes a pickup roller assembly picking up a sheet of paper and transferring the paper, a stopper controlling the paper so that a front end of the paper is located on a lower portion of the pickup roller, a sensing unit sensing whether the paper is loaded or not on the paper feeding board, and a probe unit that is rotated with the stopper and turns on/off the sensor unit. Therefore, the probe unit for turning the sensor unit on/off is operated with the stopper to reduce the number of components, thus reducing the cost and stabling the quality of product.

19 Claims, 6 Drawing Sheets

U.S. PATENT DOCUMENTS

| | | | | |
|---|---|---|---|---|
| 6,032,946 | A * | 3/2000 | Marshall et al. | 271/152 |
| 6,089,563 | A * | 7/2000 | Takashimizu et al. | 271/117 |
| 6,131,898 | A * | 10/2000 | Hiroi et al. | 271/10.03 |
| 6,227,533 | B1 * | 5/2001 | Jang | 271/109 |
| 6,299,156 | B1 * | 10/2001 | Kaneda et al. | 271/117 |
| 6,431,541 | B2 * | 8/2002 | Kuo et al. | 271/118 |
| 6,547,235 | B2 * | 4/2003 | Higaki | 271/10.01 |
| 6,581,924 | B2 * | 6/2003 | Gaarder et al. | 271/114 |
| 6,651,972 | B2 * | 11/2003 | Hsiao et al. | 271/114 |
| 6,651,973 | B2 * | 11/2003 | Gaarder et al. | 271/117 |
| 6,659,449 | B2 * | 12/2003 | Kim | 271/117 |
| 6,792,241 | B2 * | 9/2004 | Nakagawa et al. | 399/367 |
| 6,991,227 | B2 * | 1/2006 | Kim | 271/10.12 |
| 6,994,341 | B2 * | 2/2006 | Aoki et al. | 271/117 |
| 2002/0074711 | A1 * | 6/2002 | Higaki | 271/117 |
| 2002/0084574 | A1 * | 7/2002 | Kim | 271/118 |
| 2003/0026633 | A1 * | 2/2003 | Nakagawa et al. | 399/367 |
| 2003/0085506 | A1 * | 5/2003 | Kubo | 271/117 |
| 2003/0132566 | A1 * | 7/2003 | Tsuei | 271/3.14 |
| 2004/0041331 | A1 * | 3/2004 | Sonoda et al. | 271/121 |
| 2004/0046308 | A1 * | 3/2004 | Park | 271/121 |
| 2004/0071486 | A1 * | 4/2004 | Manabe et al. | 399/367 |
| 2007/0001374 | A1 * | 1/2007 | Lee | 271/117 |

FOREIGN PATENT DOCUMENTS

| | | | |
|---|---|---|---|
| JP | 06171771 | A * | 6/1994 |
| JP | 08310668 | A * | 11/1996 |
| JP | 09-077308 | | 3/1997 |
| JP | 2002-255362 | | 9/2002 |

* cited by examiner

PAPER FEEDING DEVICE

CROSS-REFERENCE TO RELATED APPLICATIONS

This application claims the benefit of Korean Patent Application No. 2003-50490, filed on Jul. 23, 2003, in the Korean Intellectual Property Office, the disclosure of which is incorporated herein by reference.

BACKGROUND OF THE INVENTION

1. Field of the Invention

The present invention relates to an image forming apparatus, and more particularly, to a paper feeding device including a paper sensing device which decides whether a sheet of paper is loaded.

2. Description of the Related Art

In general, an image forming apparatus such as a laser printer, a scanner, and a multi functional peripheral device is an apparatus for forming a visual image by providing a sheet of paper with ink or toner according to data to be printed.

The image forming apparatus includes a plurality of sensors on a transfer passage of the paper for sensing whether the paper is transferred smoothly along the transfer passage or not.

Especially, one of the sensors is a paper sensing device, which can sense the paper is loaded or not. The paper sensing device senses the paper loading to perform a pre-operation of a paper pickup operation for forming the visual image on the paper.

On the other hand, devices having different functions are combined to be a device having multi-functions at present, thus a multi-functional peripheral device combining the devices having different functions such as the printer, scanner, copying machine, and facsimile is developed.

The combination of the devices accompanies miniaturization of components, and the components also have multi-functions.

Accordingly, in a pickup roller assembly, which picks a sheet of paper up and transfers the paper into the main body, a pickup roller and a sensing device are disposed independently, thus complicating the device and increasing cost due to a lot of components.

SUMMARY OF THE INVENTION

An aspect of the present invention provides a paper feeding device in which a paper stopper for controlling the position of a front end of a sheet of paper can also perform a function of sensing whether the paper is loaded, thereby to obtain an economic and reliable printing quality.

According to an aspect of the present invention, a paper feeding device includes a pickup roller assembly picking a paper up and transferring the paper, a paper sensing device sensing whether the paper is loaded on a sheet of paper feeding board and a stopper controlling the paper so that a front end of the paper is located below the pickup roller. In addition, the paper sensing device includes a sensing unit and a probe unit, which is installed to be rotated with the stopper, turning the sensor unit on/off.

BRIEF DESCRIPTION OF THE DRAWINGS

The above and/or other features and advantages of the present invention will become more apparent by describing in detail exemplary embodiments thereof with reference to the accompanying drawings in which.

DETAILED DESCRIPTION OF THE PREFERRED EMBODIMENTS

Figure 1:
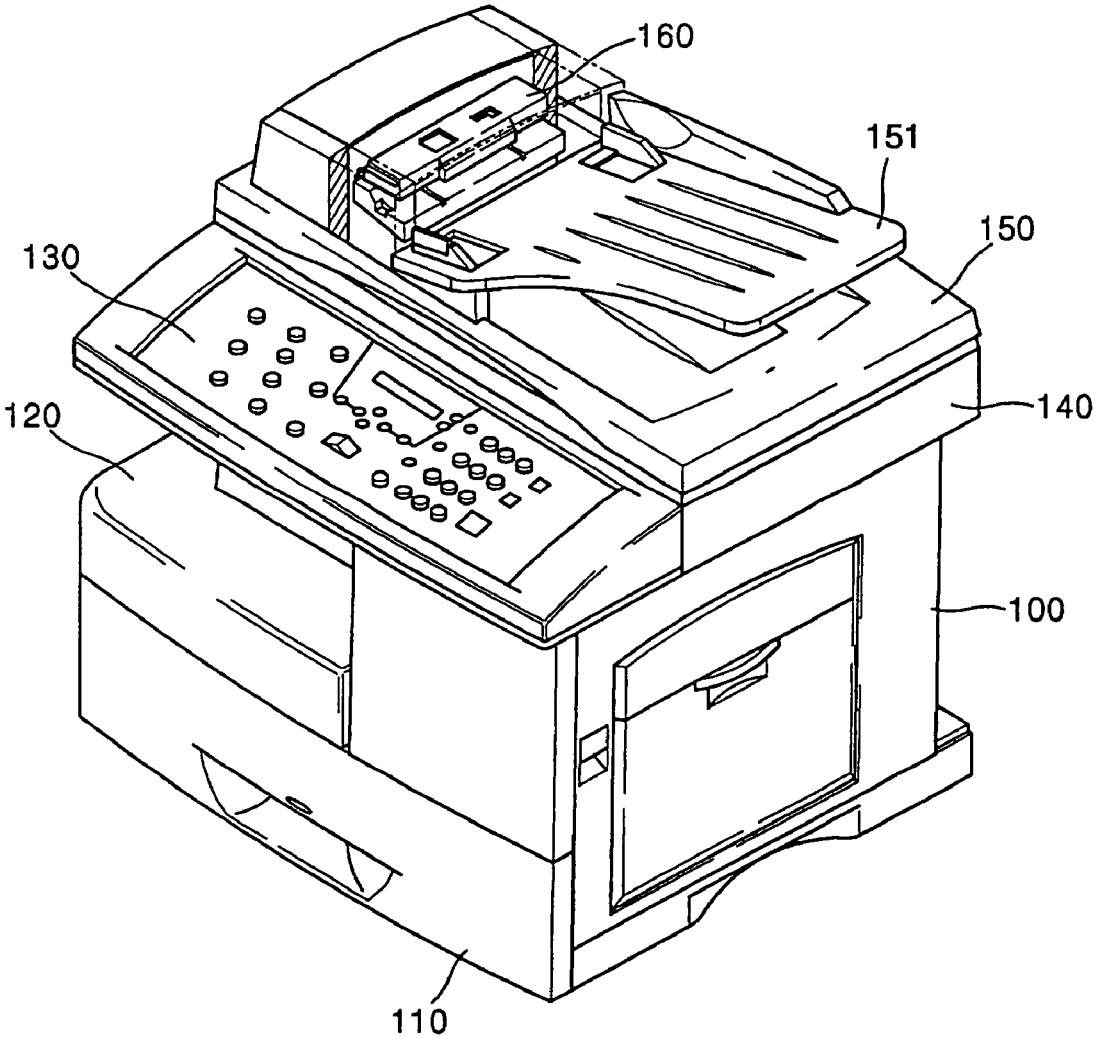
FIG. 1 is a perspective view of a multi-functional peripheral device including a paper feeding device according to an embodiment of the present invention.
Figure 2:
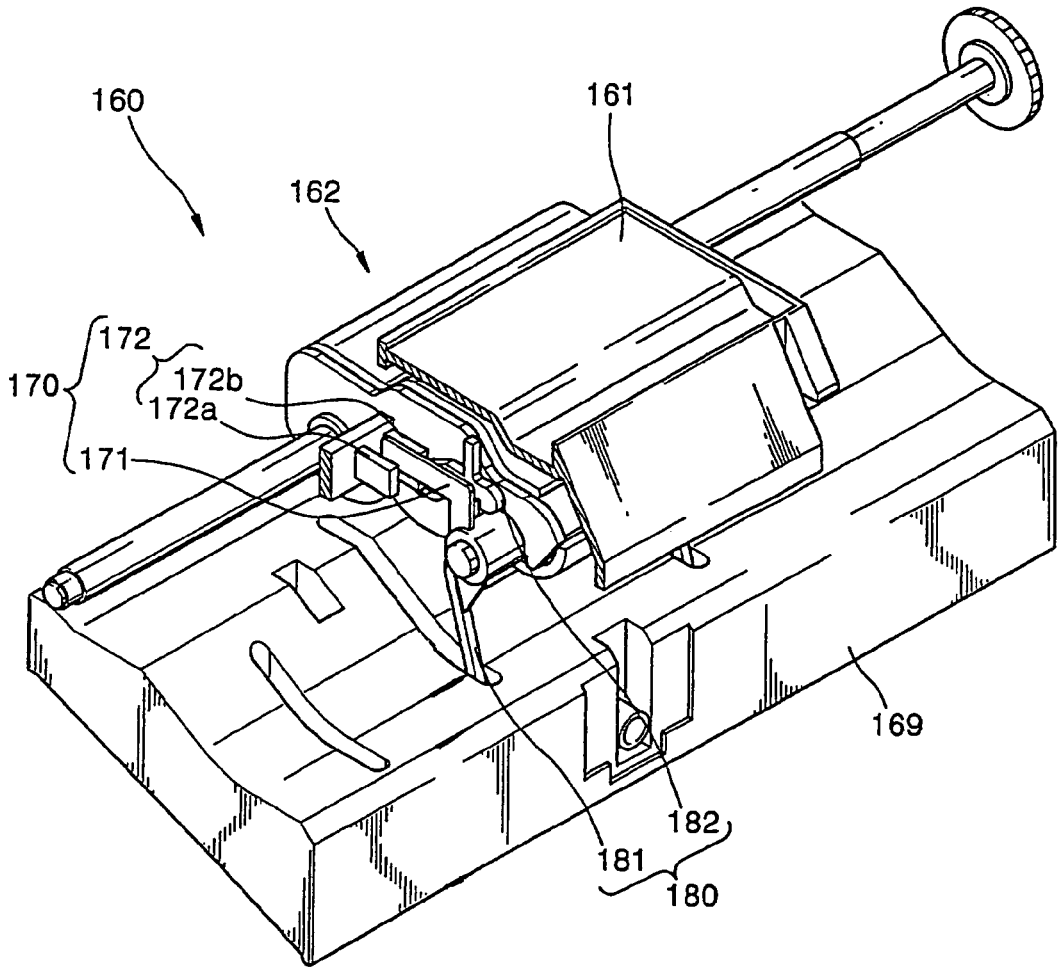
FIG. 2 is a partial perspective view of the paper feeding device of FIG. 1.
Figure 3:
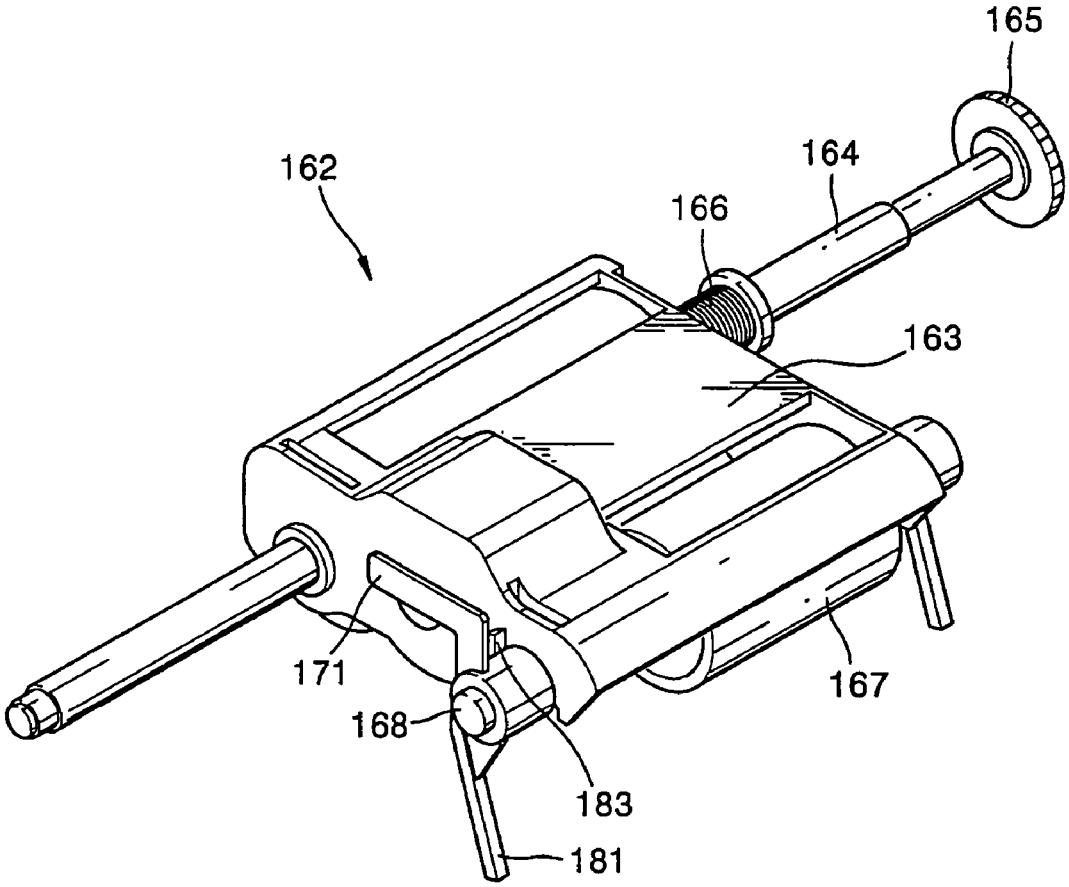
FIG. 3 is a perspective view of a pickup roller assembly of FIG. 2.

Referring to FIG. 1 through FIG. 3, a multi-functional peripheral device includes a cassette 110, which is attached/separated to/from a main body 100 on a lower portion of the multi-functional device, for loading papers, a discharging board 120, through which printed papers are discharged, disposed on an upper portion of the cassette 110, and a controlling plate 130, on which buttons for performing required operation by a user are disposed, located on an upper portion of the discharging board 120.

Also, a read-out unit 140 for reading the paper so as to perform a scanning operation and a copying operation, a paper feeding board 151 installed in a paper feeding unit above an upper portion of the read-out unit 140, with the paper feeding unit being rotatable with respect to the read-out unit 140 to feed the papers, and with a paper feeding unit 150 including a paper feeding device 160, which provides the read-out unit 140 with the papers to be read, are provided.

The paper feeding device 160 includes a pickup roller assembly 162 for picking up the paper and transferring the paper to the read-out unit 140, a paper sensing device 170 for sensing whether the paper is loaded on the paper feeding board 151 or not, and a stopper 180 for controlling the paper so that the front end of the paper is located in a lower direction of the pickup roller assembly 162.

The pickup roller assembly 162 includes a body 163 having a pickup roller 167, which is installed on one side of the body 163 to be rotatable with respect to a supporting shaft 168, and a rotary shaft 164, which is installed on the other side of the body 163 and supported within the paper feeding unit 150 what is to be rotatable, rotating by a driving power received from a driving unit (not shown) through a gear unit 165.

The pickup roller assembly 162 is covered by an upper frame 161 located thereon, and a lower frame 169 is located on a lower portion of the pickup roller assembly 162. A slit 169*a* is formed on the lower frame 169 so that the stopper 180 can move thereon.

When the pickup roller assembly 162 receives the driving power through the gear unit 165 from the driving unit (not shown), the rotary shaft 164 rotates. A clutch 166 installed on the rotary shaft 164 moves the body 163 using the rotating force of the rotary shaft 164 toward the lower direction, that is, toward the lower frame 169 centering around the rotary shaft 164. The pickup roller 167 is moved toward the lower direction with the body 163. Here, the pickup roller 167 receives the driving force from the rotary shaft 164 through a driving force transfer device (not shown) and rotates to contact and feed the paper from the paper feeding board 151.

The paper sensing device 170 includes a probe unit 171 fixedly installed on one end of the supporting shaft 168, and a sensor unit 172 fixedly installed on the upper frame 161. Preferably, the sensor unit 172 comprises a light emitting unit 172*a* radiating the light and a light receiving unit 172*b* receiving the light radiated from the light emitting unit 172*a*, which are disposed with a predetermined distance from each other.

The probe unit 171 blocks the light radiated from the light emitting unit 172*a* toward the light receiving unit 172*b* by locating between the light emitting unit 172*a* and the light receiving unit 172*b*, or makes the light radiated from the light emitting unit 172*a* go to the light receiving unit 172*b* by being out of between the light emitting unit 172*a* and the light receiving unit 172, thereby the sensor unit 172 is turned on/turned off to sense the paper.

According to an aspect of the present invention, an optical sensor is used as the sensor unit 172, however, a contact type sensor that is turned on/off by contacting the probe unit 171 or various modifications can be used as the sensor unit 172.

The stopper 180 comprises a stopping unit 181, which is installed to slide in the slit 169*a* formed on the lower frame 169, having one side fixed on both ends of the supporting shaft 168 and the other side extending toward the lower frame 169, and a suspending unit 182 installed on the upper frame 161 and selectively coupled to a suspending step 183 disposed on the supporting shaft 168 to stop the rotation of the supporting shaft 168.

Operations of the paper feeding device having above structure according to the present invention will be described with reference to accompanying figures.

Figure 4:
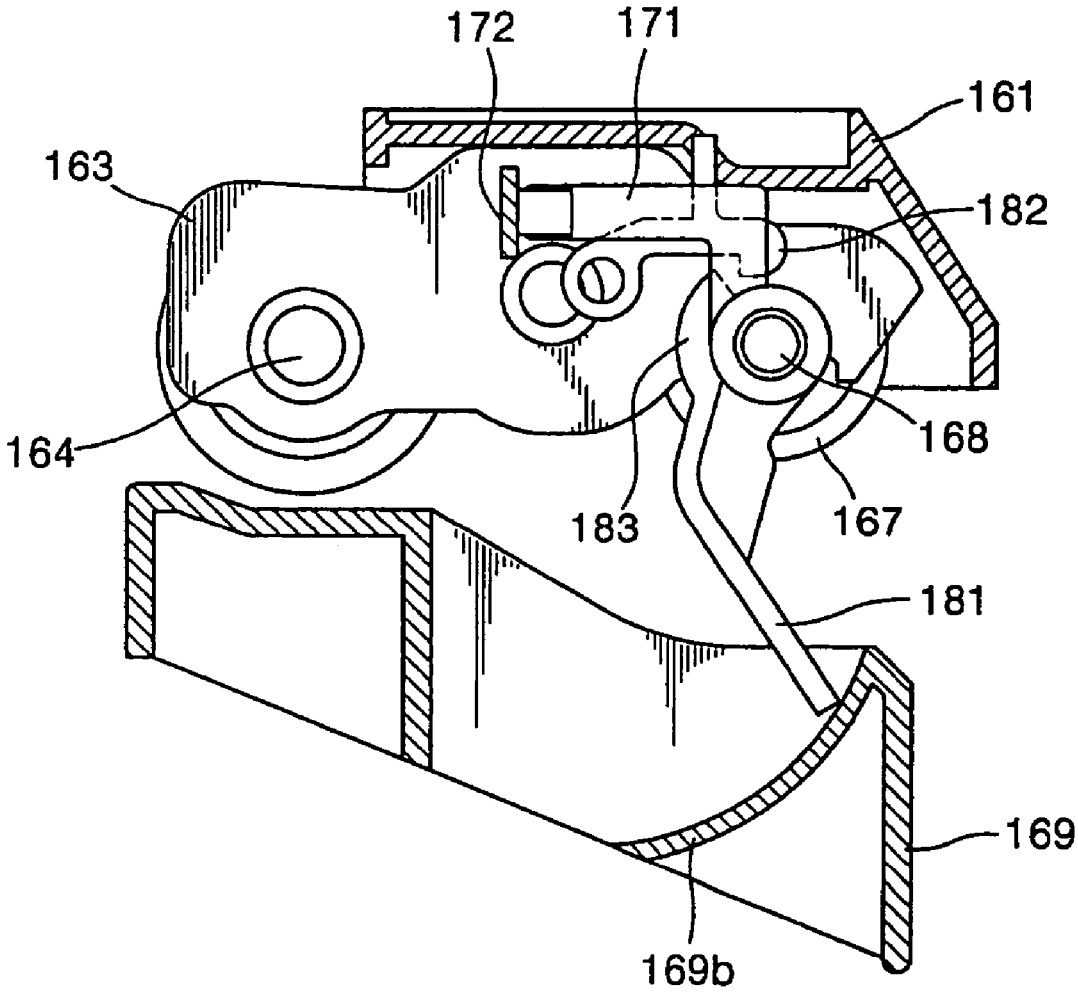
FIG. 4 through FIG. 6 are side cross-sectional views for describing operations of the paper feeding device of FIG. 1.

FIG. 4 shows a status that the paper is not provided to the paper feeding board 151 according to an aspect of the present invention. Referring to FIG. 2 and FIG. 4, the probe unit 171 is located between the light emitting unit 172*a* and the light receiving unit 172*b* of the sensor unit 172, thus blocking the light radiated from the light emitting unit 172*a* going to the light receiving unit 172*b*. Since a status where the light receiving unit 172*b* receives the light radiated from the light emitting unit 172*a* is referred to as a turned-on status, and a status where the light radiated from the light emitting unit 172*a* is blocked is referred to as a turned-off status, the status shown in FIG. 4 is the turned-off status. On the other hand, the suspending step 183 is separated a predetermined distance from the suspending unit 182.

Figure 5:
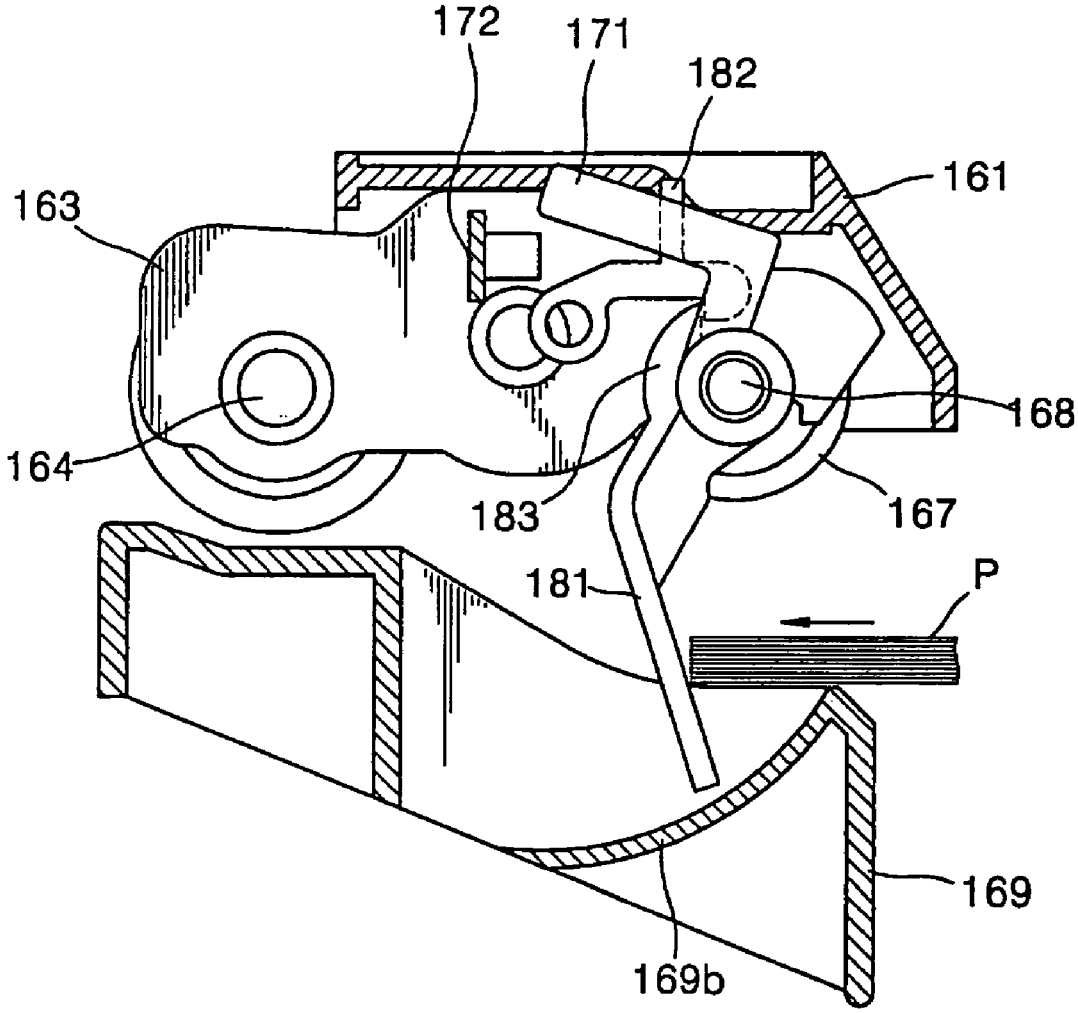

Referring to FIG. 2 and FIG. 5, when the paper (P) is loaded on the paper feeding board 151 and the front end of the paper pushes the stopping unit 181 toward the direction represented by an arrow, the stopping unit 181 rotates in a clockwise direction to rotate the supporting shaft 168. Here, the probe unit 171 is located between the light emitting unit 172*a* and the light receiving unit 172*b*, and escaped therefrom when the supporting shaft 168 rotates, then the sensor unit 172 is turned on and decides that the paper P is loaded on the paper feeding board 151.

On the other hand, when the suspending step 183 is suspended by the suspending unit 182, the stopping unit 181 prevents the paper P from proceeding toward the direction represented by the arrow.

Figure 6:
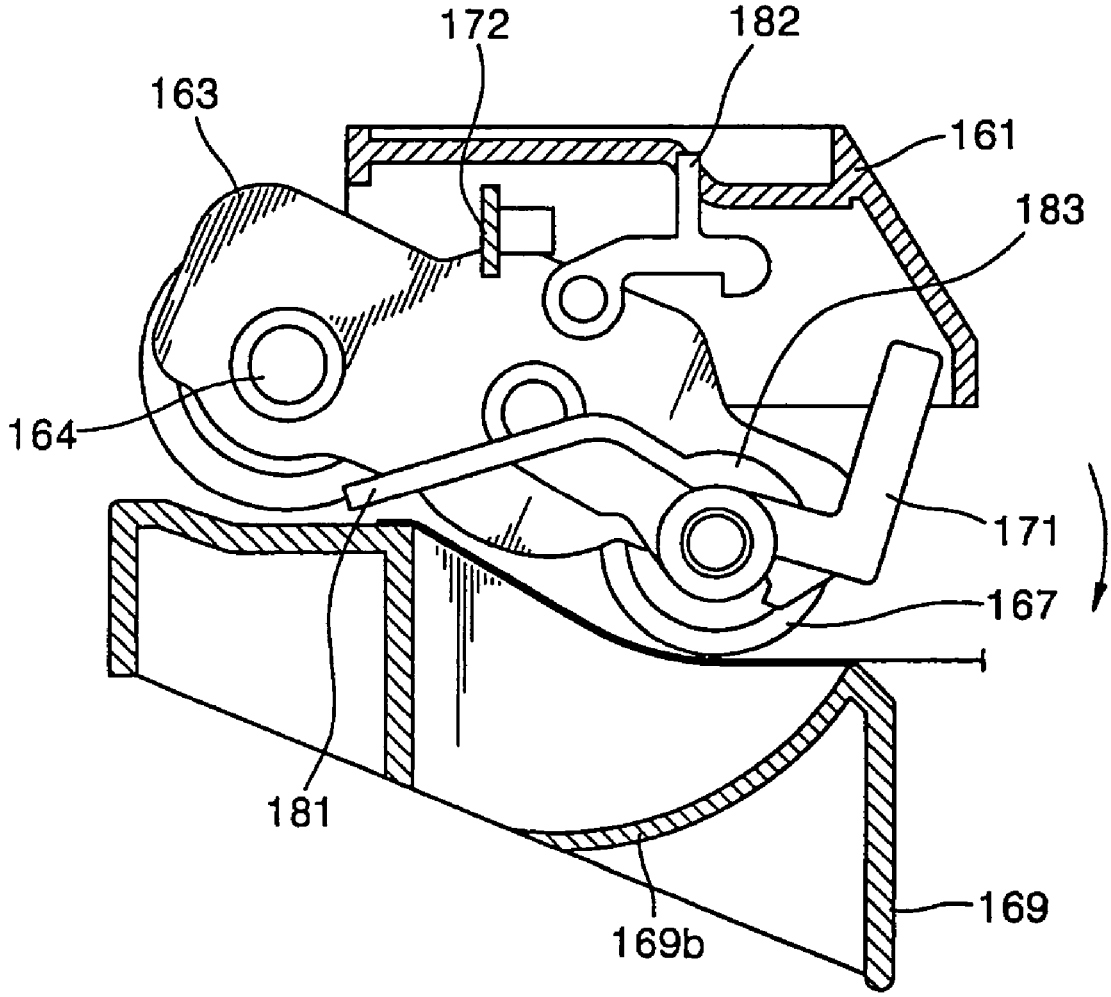

Referring to FIG. 2 and FIG. 6, when the rotary shaft 164 rotates, the body 163 rotates in a clockwise direction centering around the rotary shaft 164, and the pickup roller 167 approaches the paper P. Here, the suspending step 183 is separated from the suspending unit 182, and the stopping unit 181 slides along a guide 169*b*.

The pickup roller 167 rotates by the rotating force received from the rotary shaft 164 to pick up and transfer the paper.

As described above, according to the paper feeding device of the present invention, since the probe unit for turning the sensor unit on/off is operated with the stopper, the number of components can be reduced, thus reducing the cost and stabling the quality of product.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper feeding device comprising:

a paper feeding board;

a pickup roller assembly, including a pickup roller, picking up a sheet of paper from the feeding board and transferring the sheet of paper, the pickup roller assembly being rotatable between an upper position where the pickup roller is separated apart from the sheet of paper and a lower position where the pickup roller contacts the sheet of paper to feed the sheet of paper;

a paper sensing device sensing whether the sheet of paper is loaded on the paper feeding board; and a stopping unit rotated by the sheet of paper while controlling the sheet of paper as the sheet of paper passes underneath the pickup roller, wherein the paper sensing device comprises a sensor unit and a probe that is rotated with the stopping unit and turns on/off the sensor unit, and wherein the stopping unit, the pickup roller, and the probe simultaneously rotate about a common axis of rotation.

2. The paper feeding device of claim 1, wherein the sensor unit is installed on an upper frame, which is located on an upper portion of the pickup roller assembly, and includes a light emitting unit radiating light and a light receiving unit receiving the light radiated from the light emitting unit.

3. The paper feeding device of claim 2, wherein the probe unit is positioned between the light emitting unit and the light receiving unit upon the sheet of paper not being loaded on the paper feeding board, and escaped from the space between the light emitting unit and the light receiving unit upon the stopping unit rotating in response to the sheet of paper being loaded on the paper feeding board.

4. The paper feeding device of claim 1, further comprising a shaft wherein the probe unit and the stopping unit are fixedly installed, the shaft being an axis going through the probe unit and the stopping unit, on which the stopping unit rotates.

5. The paper feeding device of claim 1, wherein the sensor unit comprises an optical sensor.

6. The paper feeding device of claim 1, wherein the sensor unit comprises a contact sensor.

7. The paper feeding device of claim 1, wherein the pickup roller is lowered and approaches the sheet of paper after the probe unit and stopping unit are rotated clockwise to turn on the sensor unit.

8. The paper feeding device of claim 1, further comprising:

a suspending unit installed on a frame; and a suspending step to rotate as the stopping unit rotates, and to contact the suspending unit to limit an angle of rotation of the stopping unit, wherein in the upper position, when the sheet of paper is loaded on the paper feeding board, the stopping unit is pushed by the sheet of paper, rotates to an extent, and is stopped by contact with the suspending unit and the suspending step; and wherein in the lower position, the suspending step is released from the suspending unit and the stopping unit rotates as the pickup roller feeds the sheet of paper.

9. A method of sensing a sheet of paper, comprising:

stopping the sheet of paper with a stopping unit upon a front end of the sheet of paper contacting the stopping unit; and rotating the stopping unit by the sheet of paper as the sheet of paper passes underneath a pickup roller and simultaneously moving a probe which senses whether the sheet of paper is loaded, wherein the rotating comprises simultaneously rotating the stopping unit, the pickup roller, and a probe about a common axis of rotation, the probe sensing whether the sheet of paper is loaded.

10. A method of feeding a sheet of paper, comprising:

stopping the sheet of paper with a stopping unit upon the sheet of paper contacting the stopping unit as the sheet of paper passes underneath a pickup roller; and rotating the stopping unit and simultaneously moving the pickup roller downwards until the pickup roller contacts the sheet of paper to enable the pickup roller to feed the sheet of paper, wherein the rotating comprises simultaneously rotating the stopping unit, the pickup roller, and a probe about a common axis of rotation, the probe sensing whether the sheet of paper is loaded.

11. A paper feeding device comprising:

a pickup roller assembly picking up a sheet of paper and transferring the sheet of paper, the pickup roller assembly comprising a pickup roller, the pickup roller assembly being rotatable to allow the pickup roller to contact the sheet of paper to feed the sheet of paper; and a stopping unit contacting the sheet of paper to stop the sheet of paper and being connected to the pickup roller so that the stopping unit rotates as the sheet of paper passes under the pickup roller allowing downward movement of the pickup roller to contact the sheet of paper, wherein the stopping unit, the pickup roller, and a probe simultaneously rotate about a common axis of rotation, the probe sensing whether the sheet of paper is loaded.

12. The paper feeding device of claim 11, wherein the pickup roller and the stopping unit are fixed to a shaft for the common axis of rotation.

13. The paper feeding device of claim 12, further comprising:

a suspending unit rotatably installed on a frame; and a suspending step disposed on the shaft, to rotate as the pickup roller and stopping unit rotate, and to contact to limit an angle of rotation of the shaft.

14. A paper feeding device comprising:

a probe to sense whether a sheet of paper is loaded; and a stopping unit contacting the sheet of paper to stop the sheet of paper and being connected to the probe so that the stopping unit is moved by the sheet of paper as the sheet of paper passes under a pickup roller simultaneously with movement of the probe to sense the loading of the sheet of paper, the probe and the stopping unit being coupled to a shaft for a common axis of rotation;

a pickup roller assembly fixed to the shaft, the pickup roller assembly comprising the pickup roller, wherein the pickup roller rotates to contact the sheet of paper simultaneously with the rotation of the stopping unit and the probe, to enable the pickup roller to feed the sheet of paper.

15. The paper feeding device of claim 14 further comprising:

a suspending unit rotatably installed on a frame; and a suspending step disposed on the shaft, to rotate as the pickup roller, stopping unit and probe rotate, and to contact-to limit an angle of rotation of the shaft.

16. The paper feeding device of claim 14, further comprising:

a light emitting unit; and a light receiving unit;

wherein the probe is between the light emitting unit and light receiving unit upon the stopping unit being positioned to stop the sheet of paper and is not between the light emitting unit and light receiving unit upon the stopping unit being moved to enable passage of the sheet of paper.

17. A paper feeding device comprising:

a probe to sense whether a sheet of paper is loaded;

a stopping unit contacting the sheet of paper to stop the sheet of paper and being connected to the probe so that the stopping unit is moved by the sheet of paper as the sheet of paper passes under a pickup roller simultaneously with movement of the probe to sense the loading of the sheet of paper;

a suspending unit rotatably installed on a frame; and a suspending step disposed on a shaft, to rotate as the stopping unit and probe rotate, and to contact to limit an angle of rotation of the shaft, wherein the probe and the stopping unit are fixed to the shaft for a common axis of rotation.

18. The paper feeding device of claim 17, further comprising:

a light emitting unit; and a light receiving unit;

wherein the probe is between the light emitting unit and light receiving unit upon the stopping unit being positioned to stop the sheet of paper and is not between the light emitting unit and light receiving unit upon the stopping unit being moved to enable passage of the sheet of paper.

19. A paper feeding device comprising:

an upper frame and a lower frame corresponding to the upper frame;

a pickup roller assembly installed to be rotatable to a lower direction with respect to the upper frame and including a pickup roller to pick up a sheet of paper loaded in a paper feeding board;

a stopping unit disposed on both ends of a supporting axis of the pickup roller and rotated by the sheet of paper while controlling the sheet of paper as the sheet of paper passes underneath the pickup roller; and a sensing device including a probe unit, which is disposed on the supporting axis, and a sensor unit, which is disposed on the upper frame and is turned on/off by the probe unit, wherein the stopping unit and the probe unit are connected to the supporting axis and are rotated when the pickup roller rotates to pick up the sheet of paper.

* * * * *